US008790009B2

(12) United States Patent
Saville et al.

(10) Patent No.: US 8,790,009 B2
(45) Date of Patent: Jul. 29, 2014

(54) BAG WITH SECONDARY HANDLE

(75) Inventors: Tara J. Saville, Kailua Kona, HI (US); Mark D. Sale, Kailua Kona, HI (US); Jay B. Paulson, Waikoloa, HI (US)

(73) Assignee: B3 Plastics, LLC, Kailua-Kona, HI (US)

( * ) Notice: Subject to any disclaimer, the term of this patent is extended or adjusted under 35 U.S.C. 154(b) by 46 days.

(21) Appl. No.: 13/176,737

(22) Filed: Jul. 5, 2011

(65) Prior Publication Data

US 2012/0008878 A1 Jan. 12, 2012

Related U.S. Application Data

(60) Provisional application No. 61/361,788, filed on Jul. 6, 2010.

(51) Int. Cl.

| | |
|---|---|
| ***B65D 33/06*** | (2006.01) |
| ***B65D 33/00*** | (2006.01) |
| ***B31B 1/00*** | (2006.01) |
| ***B65F 1/00*** | (2006.01) |
| ***B65D 33/28*** | (2006.01) |
| ***B65D 30/08*** | (2006.01) |
| ***B65D 33/16*** | (2006.01) |
| ***B65F 1/14*** | (2006.01) |
| ***B65D 33/01*** | (2006.01) |
| ***B65D 33/08*** | (2006.01) |

(52) U.S. Cl.

CPC ..... *B65D 33/01* (2013.01); *B31B 2219/9093* (2013.01); *B31B 1/00* (2013.01); *B65F 1/0006* (2013.01); *B31B 2237/10* (2013.01); *B65D 33/28* (2013.01); *B31B 2219/909* (2013.01); *B65D 31/04* (2013.01); *B65D 33/1608* (2013.01); *B65F 1/1468* (2013.01); *B31B 2219/148* (2013.01); *B65D 33/08* (2013.01)

USPC ..... 383/16; 383/6; 383/7; 383/10; 383/37

(58) Field of Classification Search

CPC .... B65D 33/001; B65D 33/002; B65D 33/06; B65D 33/065; B65D 33/08; B65D 33/14

USPC ..... 383/16, 7, 10, 14, 71, 77, 6, 32, 37; 206/554

See application file for complete search history.

(56) References Cited

U.S. PATENT DOCUMENTS

| | | | | |
|---|---|---|---|---|
| 1,605,141 | A | 11/1926 | Pyle | |
| 3,762,542 | A * | 10/1973 | Grimes | 206/525 |
| D235,739 | S * | 7/1975 | Christensen | D9/704 |
| 3,961,743 | A * | 6/1976 | Hollowell | 383/7 |
| 4,445,230 | A * | 4/1984 | Spadaro | 383/7 |

(Continued)

*Primary Examiner* — Jes F Pascua
*Assistant Examiner* — Nina Attel
(74) *Attorney, Agent, or Firm* — Sean D. Burdick

(57) ABSTRACT

A bag has a body portion having a seam forming a pocket, an opening in the body portion arranged to receive items, a first handle located adjacent to the opening, and a second handle arranged adjacent to the seam, off-set from the first handle. A method of manufacture a bag having two handles includes providing stock in the form of a tubular plastic film stock, forming a first bag from the tubular plastic film stock, the first bag having a first handle at a top of the bag, and a second handle at a bottom of the bag, and forming a second bag from the tubular plastic film stock, the second bag having a first handle at a top of the second bag, the first handle of the second bag arranged adjacent the bottom handle of the first bag.

19 Claims, 8 Drawing Sheets

(56) References Cited

U.S. PATENT DOCUMENTS

| | | | | |
|---|---|---|---|---|
| 4,629,064 | A | 12/1986 | Barner | |
| 5,782,562 | A * | 7/1998 | Anspacher | 383/15 |
| 6,149,555 | A | 11/2000 | Kinback | |
| 2005/0053313 | A1 | 3/2005 | Lucas et al. | |
| 2005/0157956 | A1 * | 7/2005 | Geyer | 383/5 |
| 2005/0276521 | A1 * | 12/2005 | Price | 383/10 |
| 2006/0012200 | A1 * | 1/2006 | Kohn et al. | 294/152 |
| 2006/0233470 | A1 * | 10/2006 | Jacoby et al. | 383/40 |
| 2008/0128416 | A1 * | 6/2008 | Odabashian | 220/200 |
| 2009/0004414 | A1 | 1/2009 | Gelbard | |
| 2010/0054634 | A1 * | 3/2010 | Runyon et al. | 383/10 |
| 2010/0142859 | A1 * | 6/2010 | Cushman | 383/10 |
| 2010/0296754 | A1 * | 11/2010 | Chiu | 383/10 |

* cited by examiner

BAG WITH SECONDARY HANDLE

RELATED APPLICATIONS

This application is continuation of, and claims priority to, U.S. Provisional Patent Application No. 61/361,788, filed Jul. 6, 2010.

BACKGROUND

Overexertion back injuries rarely occur as a result of a single event or accident. The human spine typically undergoes weeks or months of heavy lifting and awkward work postures until some element of the back, including discs, vertebrae and muscles, gives out. Even for people who or not involved in day to day manual labor, injuries can result from just ordinary household tasks like taking out the trash, cleaning up the yard and discarding landscape waste, etc.

Trash bags are generally designed to have a sealed seam on the bottom and some sort of closure at the top. Closures include twist ties, drawstring handles, extensions on the top of the bag that can be tied—so-called "handle tie" bags, etc. Once closed, the user generally picks the bag up from the closure and puts it into a trash receptacle. This lifting of the waste bag from one point, generally out away from the body, is not ergonomic, and can cause injury or at the very least, fatigue.

In addition, in order to get a better grip on the bag a user may grab the body of the bag. If there is an unseen sharp object in the bag, the user runs the risk of injury by the unseen object when the user grabs the bag. Even if the user does not grab the body of the bag, the bag will typically dangle next to the user's legs as it is carried, and the user may be injured if the sharp object hits the user's leg.

Additionally, often the bag is not used anywhere near its full capacity because of concerns that the bag will rip or tear due to the poor distribution of weight. Users often cannot lift as much waste as they may desire because the awkwardness of the hanging bag prevents them from lifting more. This makes currently available fillable bags inefficient and not cost-effective.

This also applies to pre-filled or pre-packaged materials in bags. A materials supplier or manufacturer may package materials such as sand, concrete, potting soil, etc. in smaller bags to allow easier handling and movement. If there were a way to allow users to handle the material more easily, the suppliers could package the materials in larger amounts, reducing the number of bags needed per pound of material.

DETAILED DESCRIPTION OF THE EMBODIMENTS

Figure 1:
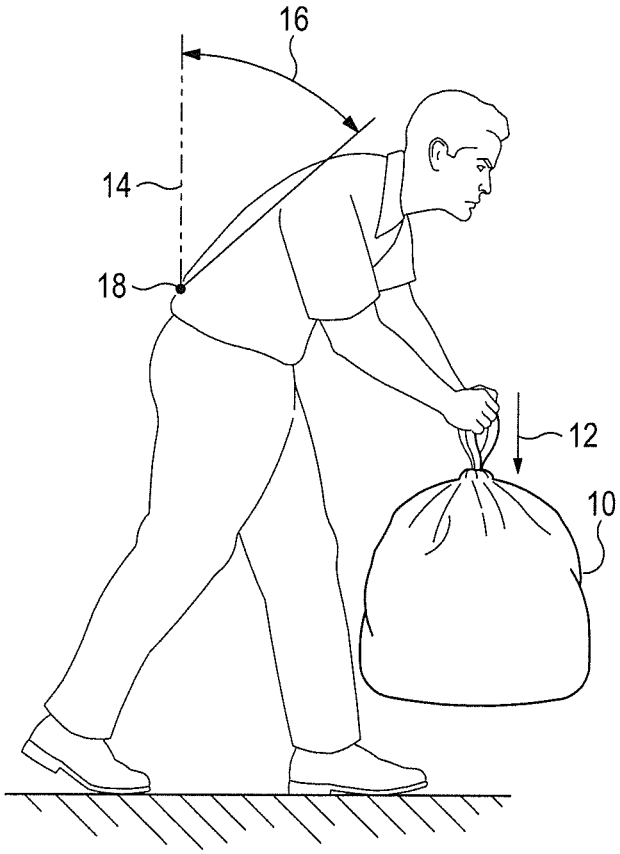
FIG. 1 shows an example of a typical trash bag use.

FIG. 1 shows an example of a user picking up a bag 10. The bag in this example is a handle tie trash bag. As can be seen, the load of the bag 10 hangs straight down from the user's arms 12. This causes the user to lean out a distance 16 from vertical, shown by line 14. This forms a fulcrum point 18 in the user's back, applying stress and strain to the back, increasing the likelihood of injury.

Figure 2:
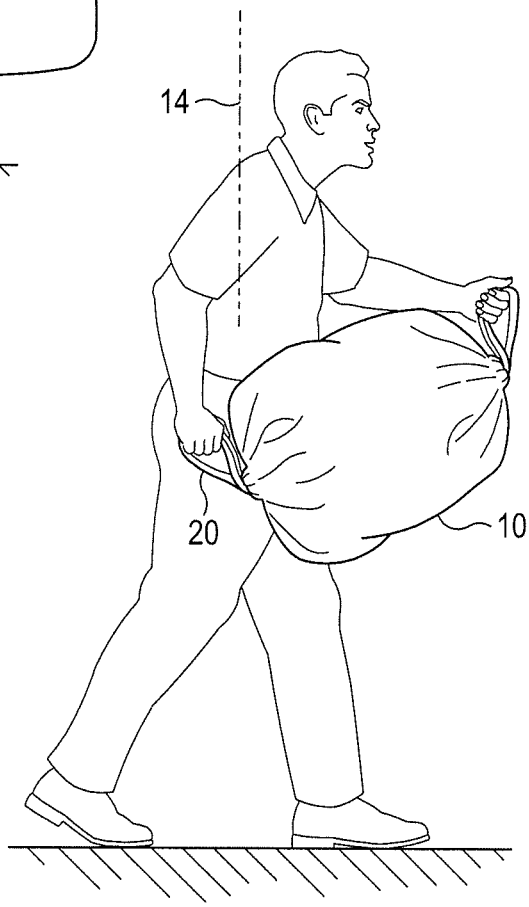
FIG. 2 shows an embodiment of a bag having a second handle to promote efficient, ergonomic use.

FIG. 2 shows an example of a user picking up a bag 10 using a bottom handle flap 20. While the user is shown bent slightly from the vertical 14, it is much more likely for the user to be able to straighten fully because of the ability to spread the arms and distribute the load across the torso evenly. Also, even with the bend from vertical, it is far easier for the user to keep the back straight with no fulcrum point that focuses the stress and strain of the load.

Figure 3:
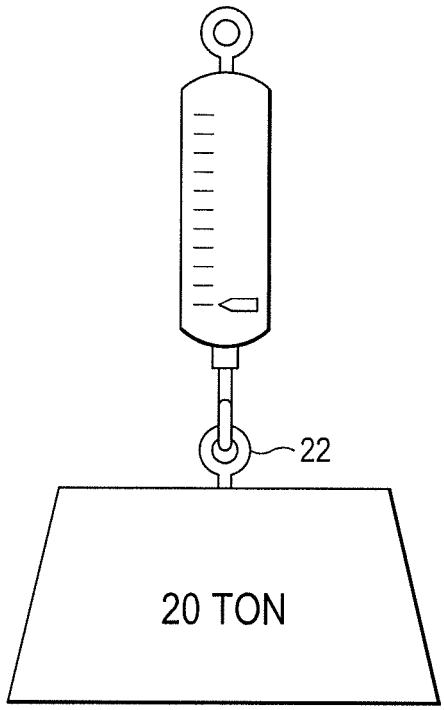
FIG. 3 shows a representation of weight distribution for a point load.
Figure 4:
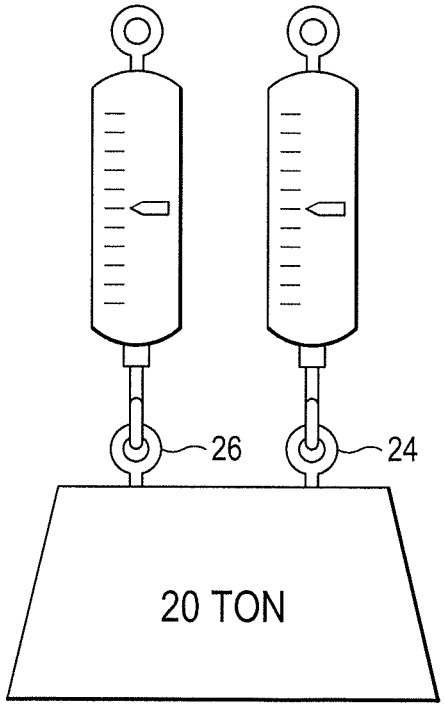
FIG. 4 shows a representation of weight distribution for a load distributed between two points.

FIG. 3 shows a single point of load 22 for a 20 ton weight. All of the force of the load is focused at the lifting point of the load 22. In contrast, FIG. 4 shows two points of load 24 and 26. The load will generally be distributed evenly between the two points. Further two points of load allow more freedom of movement and the ability to adjust the points to more evenly distribute the load. For a non-homogenous load, such as might occur in a trash bag where the contents may be a mix of items with different densities such as grass clippings and leaves, the ability to adjust the balance between two points of load provides an advantage. Having two handles allows distribution of the point load among two points.

The term bag as used here means a container for holding any material that has three closed edges ie: left edge, right edge, bottom edge, two sides ie front and back panels and an open top with or without some type of closure, Alternatively, a bag may not have three distinct edges. For example, the bag may have a body formed from flattened tubular stock with a continuous curved edge, with an opening. The top handle would be at the opening, the bottom handle flap would be located on a portion of the curved seam typically, but not necessarily, at the bottom of the bag. Examples of a bag include bags of all sizes, including household 'kitchen' bags, 'outdoor' bags, contractor bags, made of plastic, fibrous materials, paper, cardboard, or even thin cloth, and material bags filled with such items as concrete, sand, potting soil, bark mulch, grains, compost, etc. The top handle may be formed from the side edges of the opening, separate from the opening, formed from the side panels of the bag, etc. It will be referred to as being adjacent to the opening.

Figure 5A:
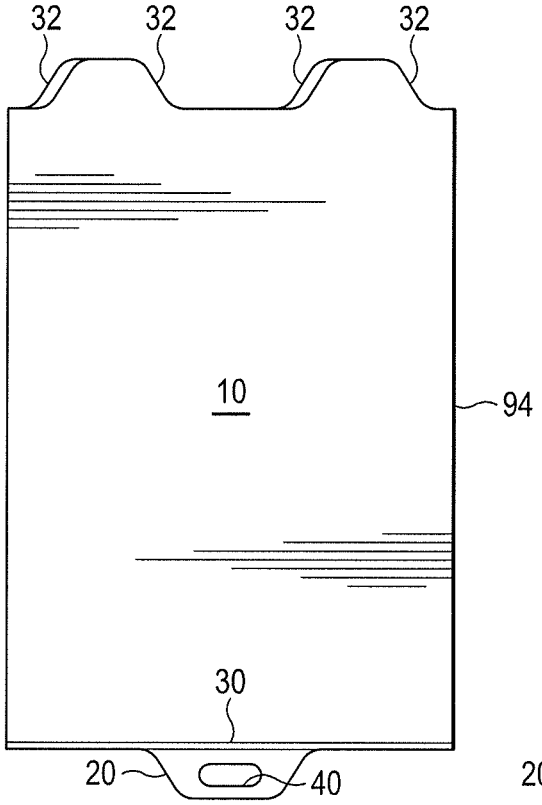
FIGS. 5A-D shows examples of differing bag handle and top shapes.
Figure 5B:
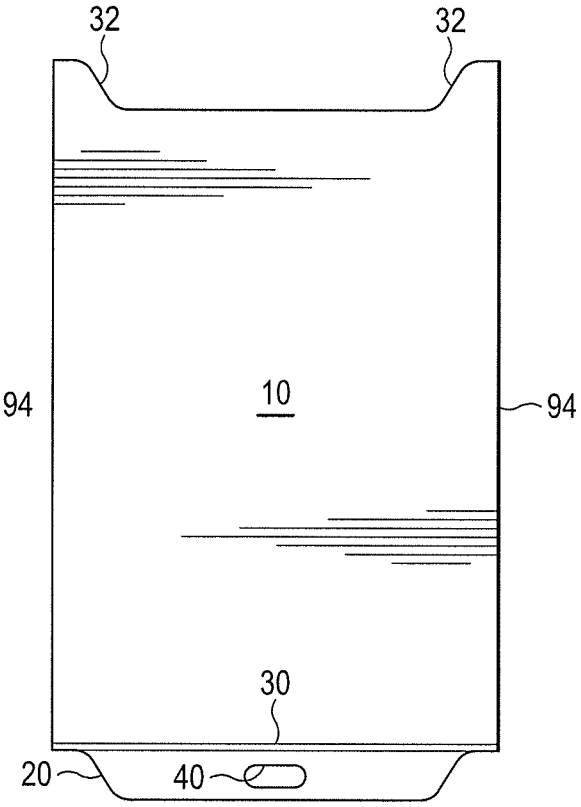

FIGS. 5A-D show embodiments of a bag body front-side and back-side panels 10, having top handle ties 32, handle flap 20 and sides/edges 94. The bottom handle flap 20 is arranged to be outside the sealed seam 30 in FIG. 5A, with a different relationship between the ties 32 and the bottom handle shown in 5B. FIG. 5B also shows a different configuration of the handle. The handle flap could be one of many shapes, sizes or types. The handle flap could be either an extension of the body side panels 10, or a separate piece of material, of the same material as the body of the bag or of a different type, joined, welded or bonded in any fashion to the body.

Figure 5C:
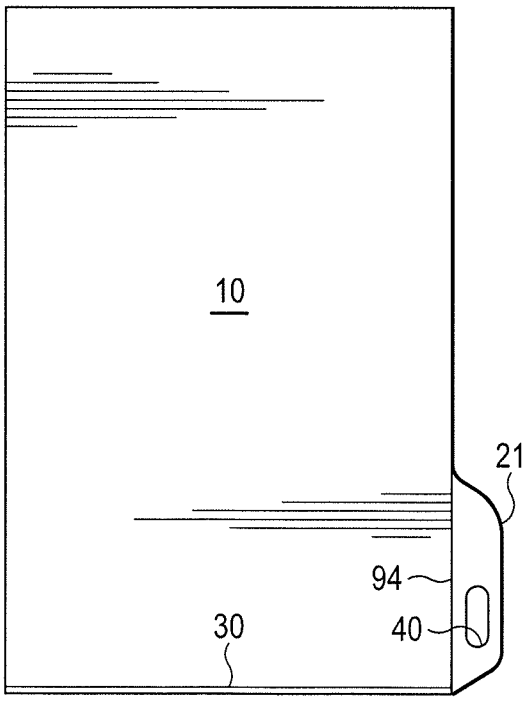
Figure 5D:
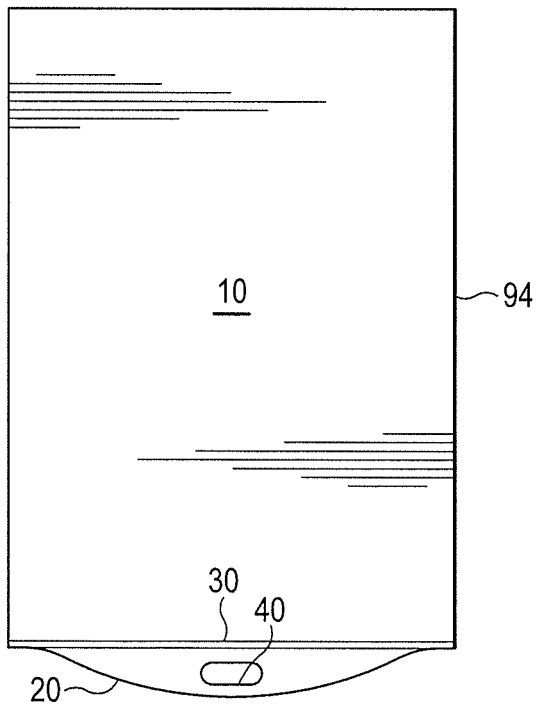

The handle flap could employ various methods of construction and is not limited in shape, size, form or location. For example the handle flap may either be joined around the perimeter as a result of many manufacture methods such as welded, fused, bonded, fused completely together by whatever method, or left unjoined and open. These options will be described in further detail in FIGS. 7, 8 and 14. The handle flap could be located in any position around the perimeter of the bag as seen on the side of the bag 21. Similarly the bag itself may not be a handle tie bag, such as shown in FIGS. 5C and 5D.

Figure 6B:
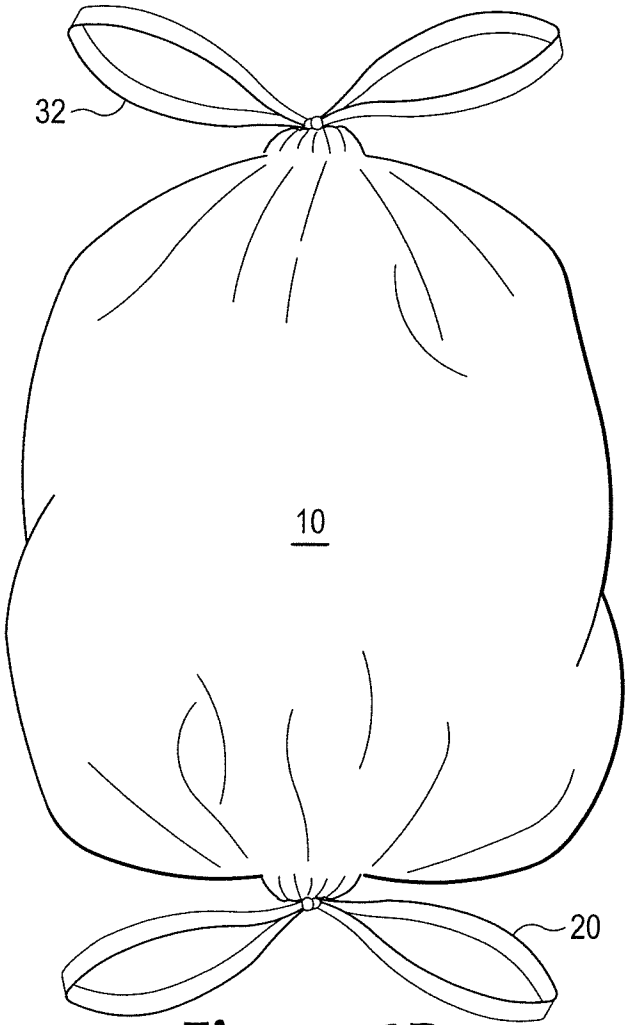
FIGS. 6A-B show an embodiment of a draw-string bag having a second draw string handle.
Figure 6A:
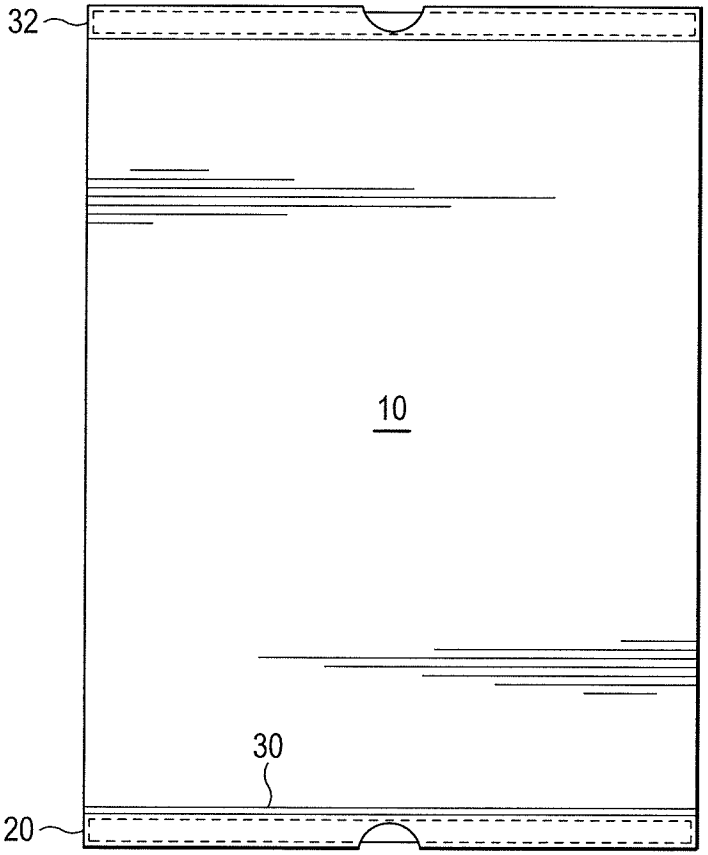

One should also note that the examples in FIGS. 6A-B show a bottom handle that is the same as the top handle, no limitation to this particular arrangement is intended, nor should any be implied. Further, the bottom handle may not actually be on the 'bottom' of this bag, it may be located on an edge or side portion of the bag.

In FIGS. 6A-B, the bag is filled from the open, also referred to here as the 'top' end of the bag at handle 32. Once filled as far as desired, the user would draw the strings in the top handle 32. The bottom handle 20, being also of the drawstring variety, would be drawn to allow the user to grasp the straps of the handle similar to the manner in which the top handle 32 is grasped, shown in FIG. 6B.

Figure 7:
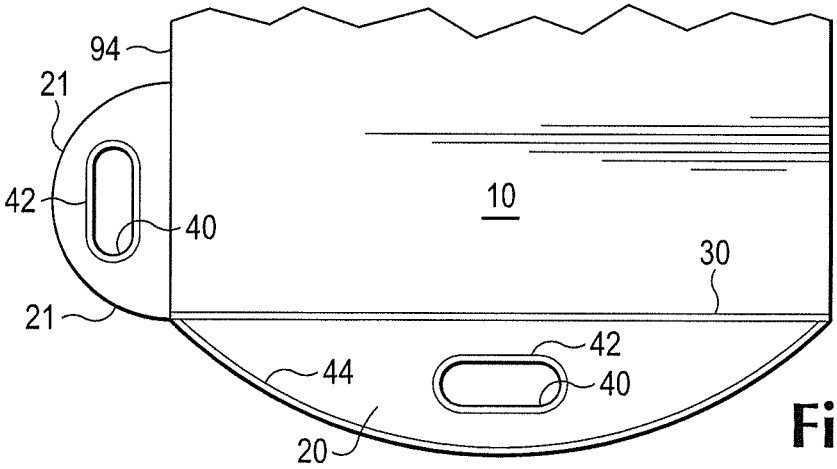
FIGS. 7-8 show differing embodiments of a second handle for a hole handle bag.
Figure 8:
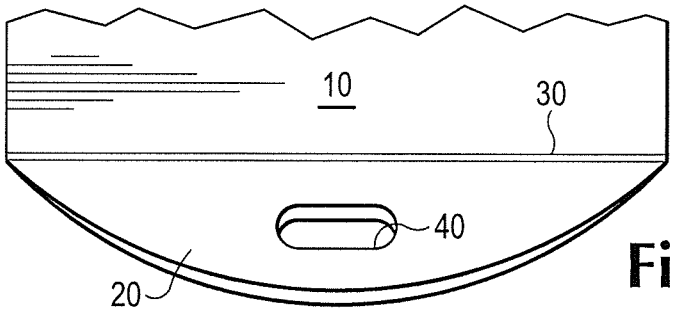

As mentioned above, the handle could be one of many types. FIGS. 7-8 show an example of a handle that is formed in the handle flap 20, referred to here as a 'hole handle' 40. In FIG. 7, two different locations for the handle are shown, but in one embodiment there could be three handles, the top handle, a bottom and a side handle, giving the user two options for lifting. The flap portion of the hole handle 40 could be an extension of the bag 10, which will be discussed in further detail with regard to manufacture below. When the bag is filled, as shown in FIG. 8, the user can grasp the hole handle 40 at the bottom of the bag to lift it more easily. Note that in FIG. 8, one can see that the handle is formed from extensions of both front and back side panels 10 of the bag, although the handle could be a single panel of material.

The bottom handle configuration may also be adjusted in size, shape, location to facilitate other uses. Ie the handle could also be located on the edge of the bag, as shown in FIG. 5 and FIG. 7. This side handle 21 would attach to the edge of the bag 94, instead of the way the handle flaps 20 attach or extend at the bottom sealed seam 30 of the bag. In addition, the handle flap and handle hole could be formed in many different ways. For example, the handle hole 40 could have the handle flaps joined, such as those shown in FIG. 7. Alternatively, as discussed below in FIG. 14 a seam 44 could seal just the perimeter of the handle flaps, and similarly just the perimeter of the hole 42, or the entire surface of the handle flaps could be bonded or sealed in any form together 46. Another example could have bonding, reinforcing or strengthening material between the flaps and then sealed.

Figure 9:
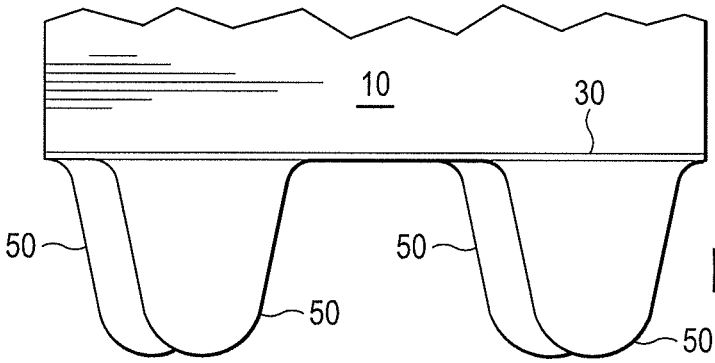
FIGS. 9-10 show an embodiment of a second handle for a handle-tie bag and drawstring bag.
Figure 10:
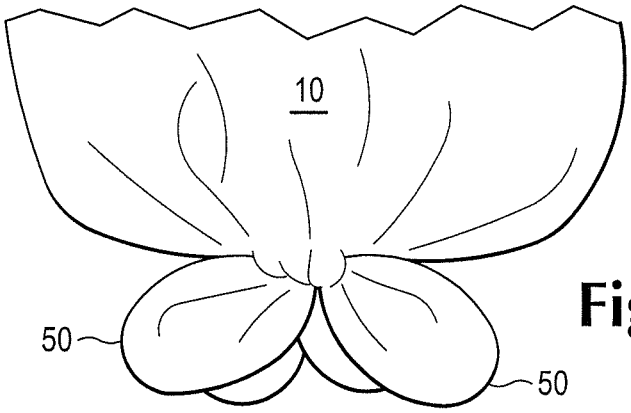

In yet another variation, FIGS. 9 and 10 shows examples of a handle-tie bag. A 'handle-tie' bag is one that has extensions, usually scalloped or otherwise curved into segments that can be tied to close the top of the bag. The bottom of the bag 10 would also have handle formed from the ties 50. When the bag is filled, shown in FIG. 10, the lower handles would be tied to allow the user to grasp them for transport. Another possible handle configuration is a perforated handle tie, where at least a portion of the handle is separated from the body of the bag by tearing along a perforation, while a portion of the handle typically remains attached to the body portion.

Other variations and modifications within the scope of the embodiments may exist. For example, the length of the handle could be adjusted to accommodate it acting as a protective layer if the bag where to be dragged over rough terrain.

Similarly, the bag may not only be used as a disposable or reusable bag that is filled by the user. Manufacturers and packagers of bulk materials, such as fertilizer, bark mulch, potting soil, sand, concrete, rice, wheat, corn, livestock feed, etc., could package their materials in bags that have a handle on either end. This would allow for more efficient and ergonomic handling of the materials by both warehouse workers and users and possibly reduce work-related injuries. The second handle may also assist in emptying the pre-packaged materials from the bag, making it easier to distribute the materials more evenly or to reach less accessible areas. In this instance, the "opening" would be the end of the bag designed to be opened, such as with a tear off strip or other mechanism that allows the bag to be opened.

Figure 11:
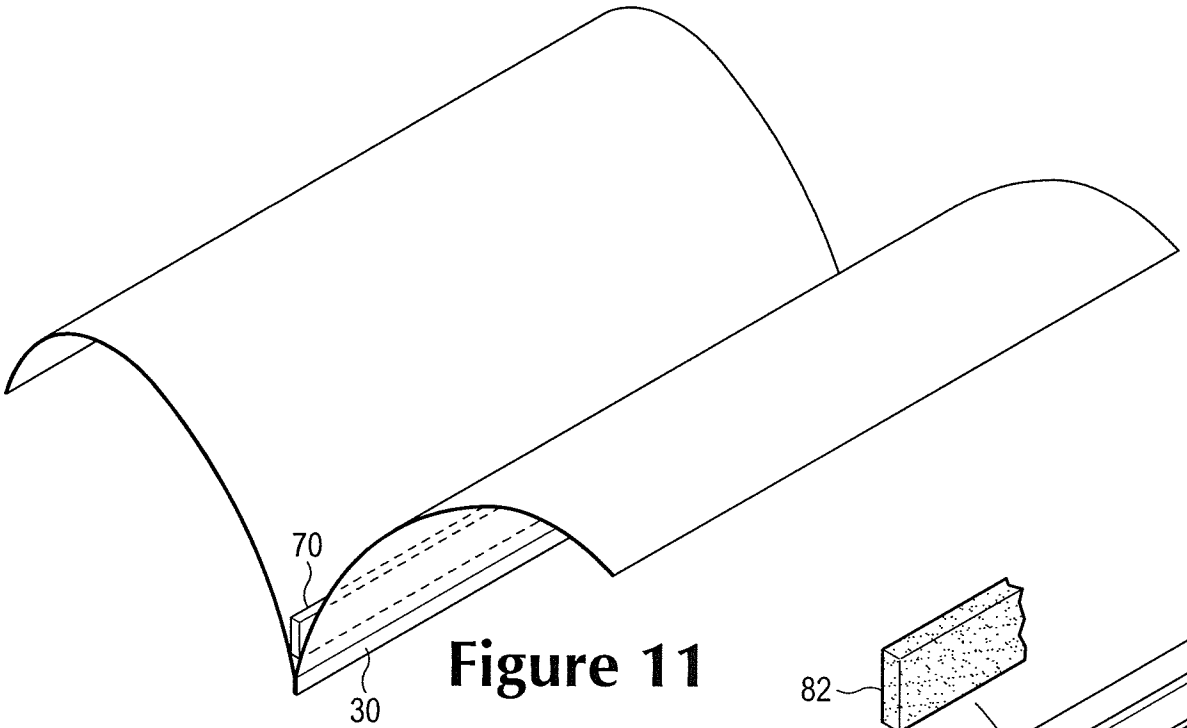
FIG. 11 shows an embodiment of a bag having an absorbent material adjacent to the bottom sealed seam.

In addition, the bag could have an absorbent strip or liner to absorb some of the accumulated fluid that may be in the material content stored or placed in the bag. As shown in FIG. 11, the bottom seal of the bag 30 by the second handle may also hold in place an absorbent strip 70. In the event of a bag rupture, the strip would have absorbed at least some of the fluid in the contents of the bag reducing the amount of fluid that would leak out of the bag.

Figure 12:
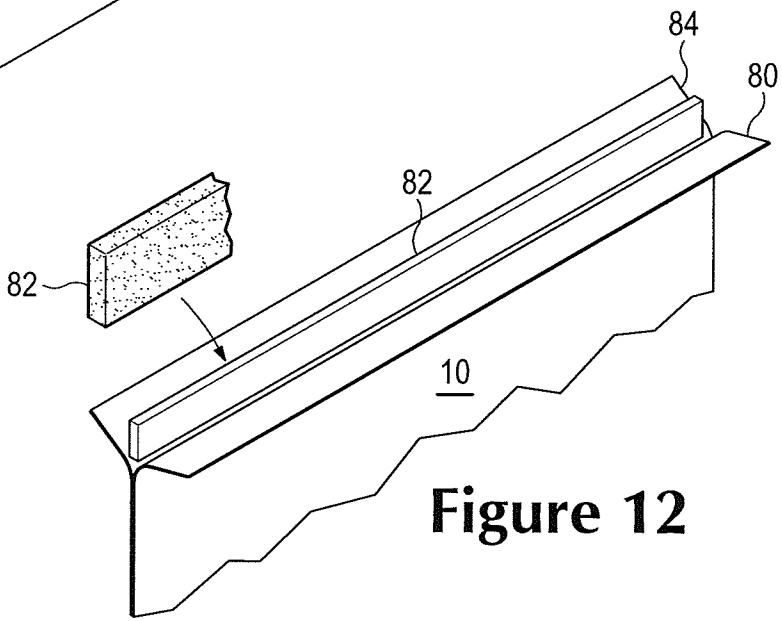
FIG. 12 shows an embodiment of a bag having an absorbent material or liner bonded between layers of the bag material.

For uses having more liquid involvement, the bag could actually be constructed having a ply system, in FIG. 12 an absorbent liner 82 is sandwiched between two plies of plastic 80 and 84. In the event of the inner ply being ruptured, the absorbent liner would absorb more of the fluids as well as acting as a more robust mechanical structure to stop further rupturing of the bag.

Typically, bags are formed from a tubular roll of stock material. The stock is laid flat, then stamped, cut or otherwise formed from the roll. The handles could be formed in the bottoms of the bags as part of the step of cutting and sealing the bottoms of the bag from the stock. As mentioned above, this would probably be fairly straightforward for the hole handle and handle tie bags.

However, one could easily see that with some slight adjustments, the drawstring bag process could easily be adapted. By leaving an extension of the bag past the bottom sealed seam, the process could add the drawstring feature to the bottom of the bag in the same manner as the top. As mentioned above, the size of the bag would not change; the flap would be made by using a longer run of the plastic stock than would be used for a standard sized bag. The position of the bag end would be the same relative to the top of the bag; the handle would be cut or stamped from an additional length of the stock material. After forming the handle, the stock would typically be cut straight to form the top of the next bag from the stock.

Figure 13:
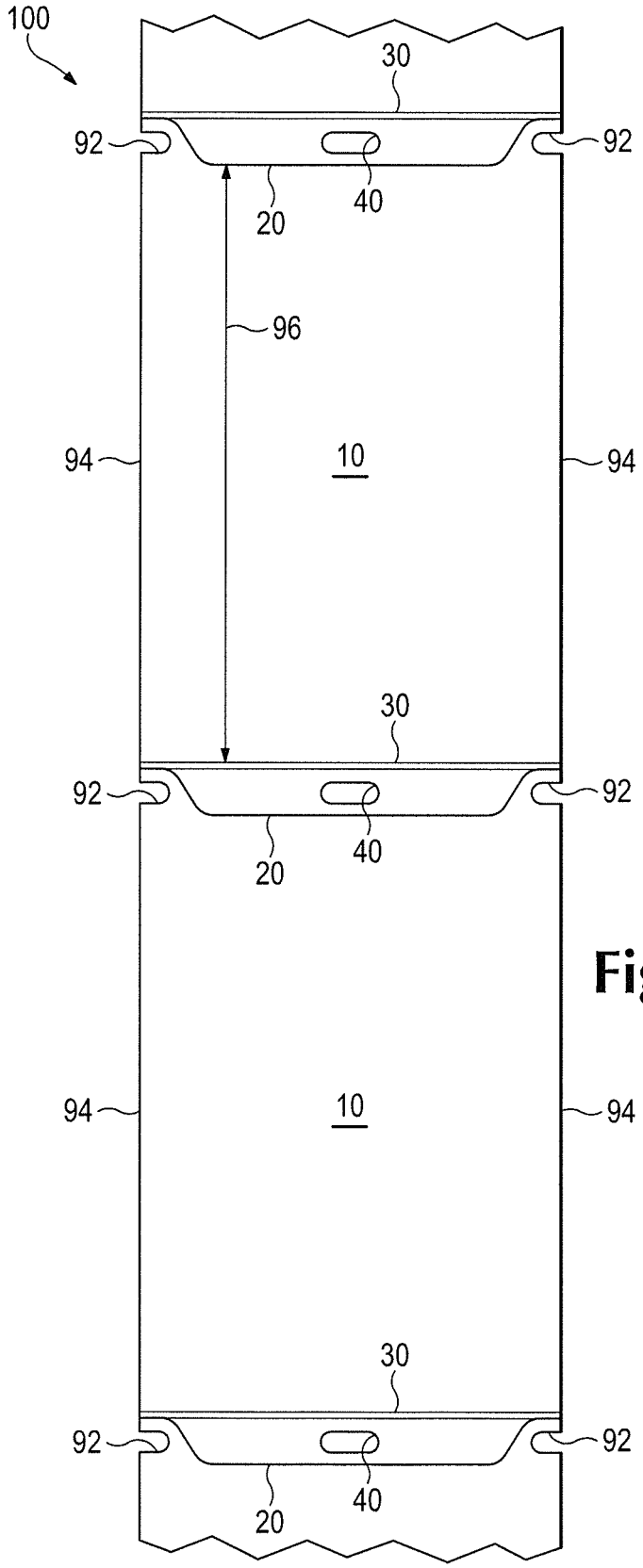
FIG. 13 shows an embodiment of manufacturing bags.

As discussed above, manufacture of the bags would more than likely use rolled or tubular stock. FIG. 13 shows an example of such stock adapted to produce bags with two handles. The stock 100 would be stamped, cut or otherwise perforated to form the individual bag outlines from the stock, such as bag 10. The sides/edges such as 94 of the bag would be formed because of the nature of the tubular stock. The bottom seam 30 would be welded or stamped for containment.

Figure 14:
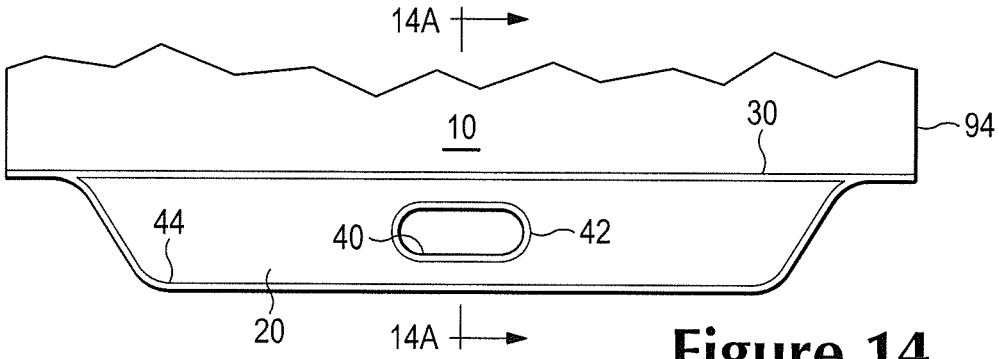
FIGS. 14-14B show an embodiment of a cross section of a bag detailing the handle and body.
Figure 14A:
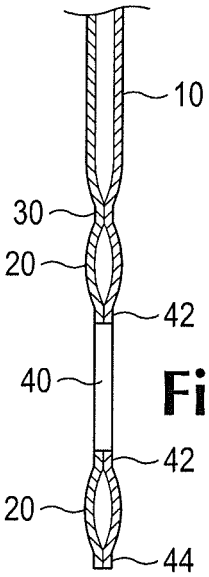
Figure 14B:
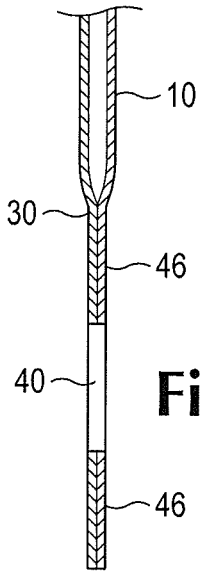
Figure 15:
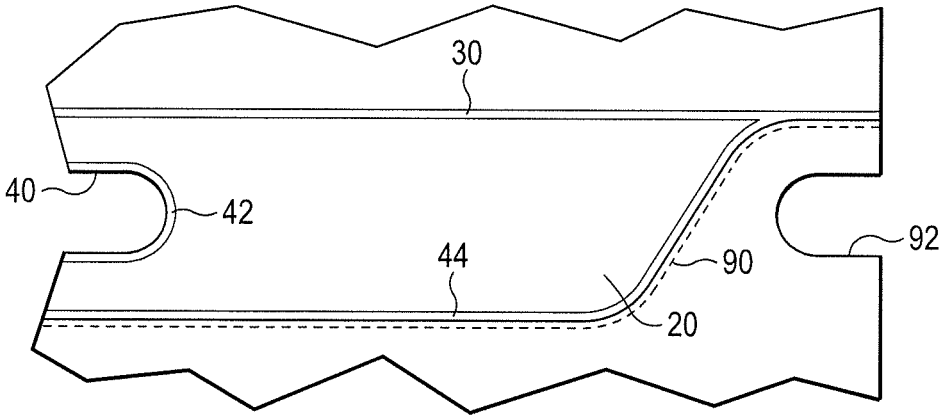
FIG. 15 shows the manufacturing seam detail of the simultaneous cut, weld, and perforation process.

FIG. 15 envisions a single manufacturing step in which all cuts, welds, and perforations are achieved at one time. This will increase CPM rates and lessen production cost making the product more viable in the market place. The lines 90 could be cut to produce individual units or perforated to package the bags as a roll. Optional upper hole handles 92 could be cut or stamped, but would not be welded together allowing the bag to be opened at the top. In FIG. 14 the shape at the mouth and bottom handle would be in addition to standard or typical bag sizes, leaving the volume/capacity of the bags unchanged. However, one could alter that configuration and remain within the scope of the embodiments described here.

In this manner, an ergonomic and more efficient bag is provided. The addition of the second handle is relatively easy and inexpensive to achieve. The second handle allows the bags to be filled more to their capacity, but allows users to move the bags more easily. As shown in FIGS. 13 and 15, the formation of the bags may be configured to form the handle ties of the next bag from the areas around the bottom handle of the previous bag. A first or upper hole handle 92 is located adjacent to the open top, is formed from the same portion of bag material, and is at least partially defined by a curved perimeter of the open top. A handle flap 20 is located below the transverse seam 30 and formed from the same portion of material. A second or lower hole handle 40 comprises a hole formed in the handle flap, wherein the hole of the second or lower handle lies substantially along a transverse axis. The first handle 92 is at least partially defined by a hole cut from a side of the flattened material between the open top and the sealed bottom. The first handle hole and second handle hole have substantially similar longitudinal height, and the handle flap 20 has a lower perimeter of a same configuration as the curved perimeter of the open top. This type of fitting together of one bag with the next is referred to here as tessellation or tessellated manufacture. When assembled into a bag roll, the hole of the first handle 92 lies substantially along the transverse axis of the hole of the second handle of a next bag in the roll.

Thus, although there has been described to this point a particular embodiment for a bag with a secondary handle, it is not intended that such specific references be considered as limitations upon the scope of the below claims.

What is claimed is:

1. A bag having a body formed from a portion of flattened material, an open top, and a bottom sealed by a transverse seam in the material, the improvement comprising:

a first handle located adjacent to the open top, formed from the same portion of material, and at least partially defined by a curved perimeter of the open top;

a handle flap located below the transverse seam and formed from the same portion of material; and a second handle comprising a hole formed in the handle flap;

wherein the first handle is at least partially defined by a hole cut from a side of the flattened material between the open top and the sealed bottom, the hole of the first handle lying substantially along a transverse axis;

wherein the handle flap has a lower perimeter of a same configuration as the curved perimeter of the open top to enable tessellated manufacture of a roll of multiple such bags from the flattened material; and wherein the first handle hole and the second handle hole have substantially similar longitudinal height, configured so that when assembled into the bag roll, the hole of the second handle lies substantially along the transverse axis of a first handle of a next bag in the roll.

2. The bag of claim 1, wherein the body comprises three closed edges.

3. The bag of claim 1, wherein the lower perimeter comprises a scalloped seam.

4. The bag of claim 1, wherein the flattened material is selected from the group consisting of plastic, fibrous material, paper, cardboard, and cloth.

5. The bag of claim 1, defined in the handle flap wherein at least a portion of a perimeter of the hole is sealed.

6. The bag of claim 5, wherein the second handle further comprises strengthening material between flaps of the second handle.

7. The bag of claim 1, wherein the lower perimeter of the handle flap is welded.

8. The bag of claim 1, further comprising a third handle located adjacent to the open top and opposite the first handle.

9. The bag of claim 1, wherein the handle flap comprises an area in which opposing walls of the bag are entirely bonded together.

10. The bag of claim 1, wherein the flattened material comprises tubular plastic stock.

11. A bag formed from a portion of flattened tubular material and having an open top and a bottom sealed by a transverse seam in the tubular material, the improvement comprising:

an upper handle located adjacent to the open top, formed from the same portion of flattened tubular material, and at least partially defined by a curved perimeter of the open top; and a handle flap located below the transverse seam and having a lower handle formed therein, the handle flap formed from the same portion of flattened tubular material and having a lower perimeter of a same configuration as the curved perimeter of the open top to enable tessellated manufacture of a roll of multiple such bags from the flattened tubular material;

wherein the upper handle is at least partially defined by a hole cut from a side of the flattened tubular material between the open top and the sealed bottom, the hole of the upper handle lying substantially along a transverse axis; and wherein the lower handle comprises a hole defined in the handle flap, the lower handle hole and the upper handle hole having substantially similar longitudinal height, configured so that when assembled into the bag roll, the hole of the lower handle lies substantially along the transverse axis of an upper handle of a next bag in the roll.

12. The bag of claim 11 wherein at least a portion of a perimeter of the hole defined in the handle flap is sealed.

13. The bag of claim 11, wherein the curved perimeter of the open top comprises a scalloped perimeter.

14. The bag of claim 11, wherein the handle flap comprises an area in which opposing walls of the bag are entirely bonded together.

15. A tessellated bag roll formed from flattened tubular material on which at least two consecutive bags are formed and removably connected by perforations, the improvement comprising:

of the consecutive bags, a first bag having a perforated top and an upper handle located adjacent to the perforated top, the upper handle formed from the flattened tubular material, at least partially defined by a curved perimeter of the perforated top, and at least partially defined by a hole cut from a side of the flattened tubular material; and of the consecutive bags, a second bag having a lower handle formed in a handle flap located below a bottom transverse seam formed in the flattened tubular material, the handle flap formed from the flattened tubular material and having a lower perimeter defined by the curved perimeter of the perforated top of the first bag, the lower handle comprising a hole defined in the handle flap;

wherein the lower handle hole of the second bag and the upper handle hole of the first bag have substantially similar longitudinal height and lie substantially along a common transverse axis.

16. The bag of claim 15, wherein the flattened tubular material comprises tubular plastic stock.

17. The bag of claim 15 wherein at least a portion of a perimeter of the hole defined in the handle flap is sealed.

18. The bag of claim 15, wherein the curved perimeter of the perforated top comprises a scalloped perimeter.

19. The bag of claim 15, wherein the handle flap comprises an area in which opposing walls of the bag are entirely bonded together.

* * * * *